US006752483B1

(12) United States Patent
Vega et al.

(10) Patent No.: US 6,752,483 B1
(45) Date of Patent: Jun. 22, 2004

(54) METHOD FOR DETECTING DROPS IN PRINTER DEVICE

(75) Inventors: Ramon Vega, Sabadell Barcelona (ES); Xavier Girones, Mora la Nova Tarragona (ES); Xavier Bruch, Sant Cugat del Valles Barcelona (ES); Antoni Murcia, San Diego, CA (US)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

(21) Appl. No.: 09/559,300

(22) Filed: Apr. 25, 2000

Related U.S. Application Data

(63) Continuation-in-part of application No. 09/502,667, filed on Feb. 11, 2000, now abandoned.

(51) Int. Cl.[7] ..... B41J 2/01

(52) U.S. Cl. ..... 347/19

(58) Field of Search ..... 347/19, 23

(56) References Cited

U.S. PATENT DOCUMENTS

| | | | | |
|---|---|---|---|---|
| 4,683,481 A | | 7/1987 | Johnson | 347/65 |
| 5,124,720 A | * | 6/1992 | Schantz | 347/19 |
| 5,276,970 A | | 1/1994 | Wilcox et al. | 33/18.1 |
| 5,278,584 A | | 1/1994 | Keefe et al. | 347/63 |
| 5,430,306 A | | 7/1995 | Ix | 250/573.6 |
| 5,434,430 A | * | 7/1995 | Stewart | 250/573 |
| 5,455,608 A | * | 10/1995 | Stewart et al. | 347/23 |
| 5,614,930 A | | 3/1997 | Osborne et al. | 347/33 |

* cited by examiner

*Primary Examiner*—Craig Hallacher
(74) *Attorney, Agent, or Firm*—Peter I. Lippman

(57) ABSTRACT

An improved apparatus for checking a plurality of printer nozzles in a printer device comprises: a print head comprising a plurality of nozzles; a means for detecting at least one droplet of ink ejected from at least one nozzle of said plurality of nozzles; and a means for performing a sequence of measurements on a first output signal of said detecting means, wherein a determination of performance of said print head is made by analysing detected output signals produced by one or a plurality of ink droplets passing the detector, the one or plurality of ink droplets containing a predetermined minimum volume of ink, and said sequence of measurements being measured at a plurality of time intervals.

26 Claims, 10 Drawing Sheets

METHOD FOR DETECTING DROPS IN PRINTER DEVICE

RELATION BACK

This is a continuation-in-part and coowned application Ser. No. 09/502,667, filed Feb. 11, 2000 and now abandoned. That document in its entirety is hereby incorporated by reference into this present document.

FIELD OF THE INVENTION

The present invention relates to printer devices, and particularly although not exclusively to a method and apparatus for improving the detection of faulty or clogged nozzles in printer devices.

BACKGROUND TO THE INVENTION

Inkjet printing mechanisms may be used in a variety of different printing devices, such as plotters, facsimile machines or inkjet printers. Such printing devices print images using a colorant, referred to generally herein as "ink." These inkjet printing mechanisms use inkjet cartridges, often called "pens," to shoot drops of ink onto a page or sheet of print media. Some inkjet print mechanisms carry an ink cartridge with an entire supply of ink back and forth across the sheet. Other inkjet print mechanisms, known as "off-axis" systems, propel only a small ink supply with the printhead carriage across the printzone, and store the main ink supply in a stationary reservoir, which is located "off-axis" from the path of printhead travel. Typically, a flexible conduit or tubing is used to convey the ink from the off-axis main reservoir to the printhead cartridge. In multicolor cartridges, several printheads and reservoirs are combined into a single unit, with each reservoir/printhead combination for a given color also being referred to herein as a "pen".

Each pen has a printhead that includes very small nozzles through which the ink drops are fired. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporisation chambers is located between a nozzle orifice plate and a substrate layer. This substrate layer typically contains linear arrays of heater elements, such as resistors, which are energised to heat ink within the vaporisation chambers. Upon heating, an ink droplet is ejected from a nozzle associated with the energised resistor.

To print an image, the printhead is scanned back and forth across a printzone above the sheet, with the pen shooting drops of ink as it moves. By selectively energising the resistors as the printhead moves across the sheet, the ink is expelled in a pattern on the print media to form a desired image (e.g., picture, chart or text). The nozzles are typically arranged in one or more linear arrays. If more than one, the two linear arrays are located side-by-side on the printhead, parallel to one another, and substantially perpendicular to the scanning direction. Thus, the length of the nozzle arrays defines a print swath or band. That is, if all the nozzles of one array were continually fired as the printhead made one complete traverse through the printzone, a band or swath of ink would appear on the sheet. The height of this band is known as the "swath height" of the pen, the maximum pattern of ink which can be laid down in a single pass.

The orifice plate of the printhead, tends to pick up contaminants, such as paper dust, and the like, during the printing process. Such contaminants adhere to the orifice plate either because of the presence of ink on the printhead, or because of electrostatic charges. In addition, excess dried ink can accumulate around the printhead. The accumulation of either ink or other contaminants can impair the quality of the output by interfering with the proper application of ink to the printing medium. In addition, if colour pens are used, each printhead may have different nozzles which each expel different colours. If ink accumulates on the orifice plate, mixing of different coloured inks (cross-contamination) can result during use. If colours are mixed on the orifice plate, the quality of the resulting printed product can be affected. For these reasons, it is desirable to clear the printhead orifice plate of such contaminants and ink on a routine basis to prevent the build up thereof. Furthermore, the nozzles of an ink-jet printer can clog, particularly if the pens are left uncapped in an office environment.

In an off-axis pen, life goal is on the order of 40 times greater than a conventional non off-axis system, e.g. the printhead cartridges available in DesignJet® 750C color printers, produced by Hewlett-Packard Company, of Palo Alto, Calif., the present assignee. Living longer and firing more drops of ink means that there are greater probability that the printer print quality degrade and/or deviate along life. This requires finding better ways to keep functional and stable our printheads during long periods and large volumes of ink fired.

In order to maintain the quality of the printed output of the printer device it is important to improve the certainty that each instruction to the printhead to produce an ink drop from a nozzle of the plurality of nozzles does will produce such an ink drop (i.e. good servicing of the printhead and replacing nozzles out with working nozzles in performing error hiding).

In the present application, the term plot means a printed output of any kind or size produced by a printing device. For instance a plot could be a printed CAD image or a printed graphic image like a photo or a poster or any other kind of printed image reproduction.

In order to maintain the quality of the printed output of the printer device it is important that each instruction to the print head to produce an ink drop from a nozzle of the plurality of nozzles does indeed produce such an ink drop. In conventional printers it is known to attempt to detect an ink drop as it leaves the nozzle during normal operation. In conventional printers this drop detection is used to indicate the end of life the of a print head.

Referring to FIG. 1 herein there is illustrated schematically a conventional drop detection system used in a production printer. An ink droplet 300 is ejected from a nozzle 220 and the droplet subsequently follows the path 310. The path 310 traced by the ink droplet 300 is configured to pass between a light emitting diode (LED) 320 and a receiving photo diode 340. The light emitted by the light emitting diode 320 is collimated by a lens 330 to produce a narrow light beam which is detected by photo diode 340. In response to the light received, photo diode 340 produces a current which is amplified by amplifier 350. Conventionally, the supply of current and hence the brightness of the light emitted by LED 320 is configured so as to provide a constant current output from photo diode 340. For example, a decrease in the output current of photo diode 340 results in an increased current to LED 320. The resulting increase and brightness of LED 320 produces an increased output current of photo diode 340.

When an ink droplet 300, fired from nozzle 220, passes through the narrow light beam between LED 320, collimating lens 330 and photo diode 340 the ink droplet 300 partially blocks the light input into photo diode 340 as a result the output current of the photo diode decreases. The decrease in the output current of photo diode 340 is detected and, as described herein before, the input current into LED 320 is increased. However, due to the comparatively slow response time of the purgatory the increase in the input current into LED 320 produces an "over shoot" in the output current of photo diode 340. Hence, the amplified current reduced by the photo diode 340 in the presence of a ink droplet 300 is to produce a characteristic pulse shape 350. In a conventional printer, the characteristic current pulse 350 produced by the passage of the ink droplet 300 is detected and counted by a prior art drop detection unit 370. In a conventional printer, a drop detection process comprises sending a signal to print head 220 to fire an ink droplet 300 and attempting to detect the resulting characteristic current pulse 350 which is counted using drop detection device 370. The steps of firing a droplet and counting that the resulting characteristic current pulse is repeated six times. If four characteristic pulses 350 are counted from the six attempts to eject an ink droplet 300 then, in a conventional system, the printer nozzle 220 is considered to be functioning correctly.

However, because of the need for three separate optical components to produce the collimated light beam in conventional drop protection systems there is a greater possibility for misalignment between the various components. Any misalignment between the LED 320, collimating lens 330 and photo diode 340 results in the width of the region in which an ink droplet 300 may be detected being reduced. In addition, because prior art drop detection systems require that a plurality of droplets are ejected and detected individually this results in a comparatively long detection time for a nozzle and waste of ink.

U.S. Pat. No. 5,430,306 (Hewlett Packard) discloses an opto electronic test device for detecting the presence of thermal-inkjet ink drops from a print head. The device includes an illumination source, a collimating aperture, a lens for focussing a collimated light beam on to a detector which converts varying illumination intensities into a varying output electrical signal. The output signal of the detector is converted to a digital signal by an analogue-to-digital converter (A/D) and the digitised output is stored as a series of samples in a memory device. Drop detection is effected by triggering an ink droplet to be ejected from a pen nozzle, and after a delay of approximately 100 $\mu$s, the droplet enters the collimated light beam. Occultation of the light input into the detector by the droplet causes a decrease in the output signal of the detector. The A/D converter samples the output signal of the detector and stores the sequence of digitised measurements in a memory. After a time delay, which is substantially longer than 100 $\mu$s, a second ink drop is triggered to be ejected from the pen nozzle and after a delay the output of the detector is again digitised. These measurements are repeated for a sequence of, typically, 8 ink droplets and an average time-profile of the output of the detector is formed by a micro-processor. A drop signal is determined to be present if, for example, the peak-to-peak voltage of the average signal is greater than a threshold value.

In order to average out noise fluctuations and derive a usable drop signal it is necessary to repeat the steps of ejecting a droplet and measuring an output signal of a detector as the droplet reverses up the light beam a number of times.

Since there is a significant delay, much longer than 100 $\mu$s, between each ink droplet ejected from the pen nozzle, the time required to test a print head comprising a plurality of pen nozzles is significant.

The drop detector which is the subject of U.S. Pat. No. 5,430,306 is designed for use in a factory environment for testing the life of print heads. The relative bulk of the strip light source, collimating apertures and focussing lens renders that invention unsuitable for implementation in individual production printer devices.

It is important, to improve the usability of production printers, to reduce the time required for characterizing a print head having a plurality of nozzles, as much as possible. However, the problem of characteristics becomes more difficult as the resolution of the printers becomes greater, as the droplet size reduces, because the signal to noise ratio of the drop detection signals reduces with reducing ink droplet size. In addition, it is important to develop more efficient use of printing ink.

SUMMARY OF THE DISCLOSURE

The specific embodiments and methods according to the present invention aim to decrease the time required to test a printer device having a plurality of ink eject nozzles prior to printing, thereby increasing the number of tests performed on the nozzles yielding an improved knowledge of the functioning of the plurality of ink eject nozzles without affecting the printing rate of such devices and thereby improving printing quality and the functional lifetime of the plurality of ink eject nozzles.

Specific methods according to the present invention, recognize that by ejecting ink droplets near a drop detection device from a number of nozzles; spitted by more than one nozzle at a time, the total number of drop detections needed provide an indication of a functioning nozzle may be reduced and hence the time taken to check the plurality of nozzles may be reduced. This enhancement is more valuable for pens of more recent generation which comprises printhead having 500 nozzles or more, e.g. some thousands per pens and for inkjet printing devices employing a larger number of pens, e.g. 6 or 12 or even more, i.e. in any embodiment in which the total number of nozzles to be monitored in considerably high, from 2000 nozzles on.

According to a first aspect of the present invention there is provided an ink jet printing device comprising: a printer head comprising a plurality of nozzles for ejecting ink; means for detecting a pre-determined sequence of droplets of ink ejected from said plurality of nozzles, said detecting means operable to generate an output signal pulse in response to said detected pre-determined sequence of droplets of ink; and means for performing a measurement on each said output signal pulse of said detecting means, wherein for a group of said nozzles, said measurement means performs measurements on an output signal pulse generated in response to said detected predetermined sequence of ink droplets containing a predetermined volume of ink.

Preferably, said group of said nozzles comprises 2 nozzles.

This allows to reduce the number of detections performed in a pen by 50%, in the case of a pen having all the nozzles working.

Typically, wherein said 2 nozzles are contiguous and said predetermined sequence of droplets is ejected in sum from nozzles in said group of nozzles. Alternatively, said predetermined sequence of droplets is ejected from each nozzle in said group of nozzles.

Suitably, said nozzles in said group of nozzles are all contiguous and in a same row of nozzles.

More preferably, said measurement means comprises a digital sampling means operable to sample said detected output signal pulse with a sampling period between samples in the range 12 $\mu$s to 50 $\mu$s.

In a preferred embodiment, said detecting means is operable. to output an analogue said output signal pulse having an amplitude perturbation comprising a first portion of a lower amplitude than a steady state amplitude output signal of said detecting means, and a second amplitude portion of a higher amplitude than said steady state amplitude output signal.

Preferably, said means for detecting said predetermined sequence of droplets of ink ejected from said at least one nozzle of said plurality of nozzles comprises: an emitting element configured to emit a light signal; a receiving element configured to receive said light signal; and a means for rigidly locating said emitting element with respect to said receiving element.

The invention includes an ink jet printing device configured to print onto a print medium, said device comprising: a print head comprising a plurality of nozzles, an elongate rigid connecting member having a first end and a second end; a first housing arranged for mounting an emitter device, said first housing rigidly attached to said first end of said elongate rigid connecting member; and a second housing arranged for mounting a detector device, said second housing attached rigidly to said second end of said elongate rigid connecting member, wherein said print head is located with respect to said first housing and said second housing such that at least two or more ink droplets ejected from a group of nozzles of said plurality of nozzles of said print head passes between said first housing and said second housing, in a trajectory which intersects a beam path between said emitter device and said detector device, said printer device further comprising means for measuring an output signal of said detector device, said measurement means operating to generate for said group of nozzles a signal indicating a performance of said group of nozzles. in response to a said detector signal resulting from passage of said two or more ink droplets containing a predetermined volume of ink across said beam path.

According to a second aspect of the present invention there is provided a method for determining an operating characteristic of a nozzle of a print head of an ink jet printer device having an ink drop detection means, said nozzle being configured to eject a plurality of drops of ink, said method comprising the steps of: sending an instruction to said print head to eject a predetermined sequence of at least two drops of ink from a group of nozzles comprising said nozzle, said predetermined sequence of at least two drops containing a predetermined volume of ink; generating an output signal of said ink drop detecting means, said output signal generated in response to said predetermined sequence of at least two ink drops; measuring said output signal of said ink drop detecting means; and determining said operating characteristic of said nozzle from said output signal.

Preferably said predetermined volume of ink lies in the range 30 picoliters to 100 picoliters.

A said predetermined sequence, in the case of black ink suitably comprises two consecutively released ink drops, and for an ink colour other than black, said predetermined sequence preferably comprises four consecutively released ink drops.

Preferably, said group of nozzles contains two nozzles and said predetermined sequence comprises two or four consecutively released ink drops per nozzle in said group of nozzles.

The step of measuring said output signal preferably comprises sampling said signal at a sample frequency in the range 30 kHz to 50 kHz. A sampling period between consecutive samples is preferably in the range 12 $\mu$s to 50 $\mu$s, and optimally of the order 25 $\mu$s.

Preferably, the step of measuring said output signal of said ink droplet detection means comprises for each of said plurality of ink drops the steps of: waiting a fixed time period after said instruction is sent to said print head; performing a sequence of measurements on said output signal of said ink drop detecting means, wherein said sequence of measurements measure said output signal of said ink drop detection means at a plurality of time intervals.

More preferably, said step of determining said operating characteristic comprises the steps of determining a value of a perturbation of said output signal; and comparing said value of perturbation with a first and a second threshold values, wherein said first threshold value is set at least six standard deviations above an average noise level of said output signal.

In addition, if said value of perturbation is equal or below said first threshold value, or equal or above said second threshold values, assign to said nozzle and the remaining nozzles in said group of nozzles the same operating characteristic.

In a preferred arrangement, said step of determining an operating characteristic of a said nozzle further comprised the step of: if said value of perturbations comprised between said first and said second threshold values, repeating the steps as claimed in claim 13 but having said group of nozzles comprising solely said nozzle.

According to a third aspect of the present invention there is provided a method for evaluating an operation of each nozzle of a print head comprising a plurality of nozzles, said nozzles being configured to eject a plurality of drops of ink, said method comprising the steps of: (a) grouping said plurality of nozzles into a number of groups of nozzles; (b) sending an instruction to said print head to eject a predetermined sequence of drops of ink from nozzles of a first group of said plurality of nozzles, each said sequence of drops containing a predetermined volume of ink; (c) generating an output signal of an ink drop detecting means for each sequence of drops detected; (d) measuring said output signal of said ink drop detecting means for each sequence of drops detected; (e) determining an operating characteristic of each nozzle in said group from said output signal; (f)If the operating characteristic of each nozzles in said group is unknown from said output signal, split said group into smaller groups containing less nozzles and repeat steps (b) to (f) for all such smaller groups (g) repeating steps (b) to (e) for each of said number of groups of nozzles.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example the best mode contemplated by the inventors for carrying out the invention. In the following description numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

Specific methods according to the present invention described herein are aimed at printer devices having a print head comprising a plurality of nozzles, each nozzle of the plurality of nozzles being configured to eject a stream of droplets of ink. Printing to a print medium is performed by moving the print head into mutually orthogonal directions in between print operations as described herein before. However, it will be understood by those skilled in the art that general methods disclosed and identified in the claims herein, are not limited to printer devices having a plurality of nozzles or printer devices with moving print heads.

Figure 1:
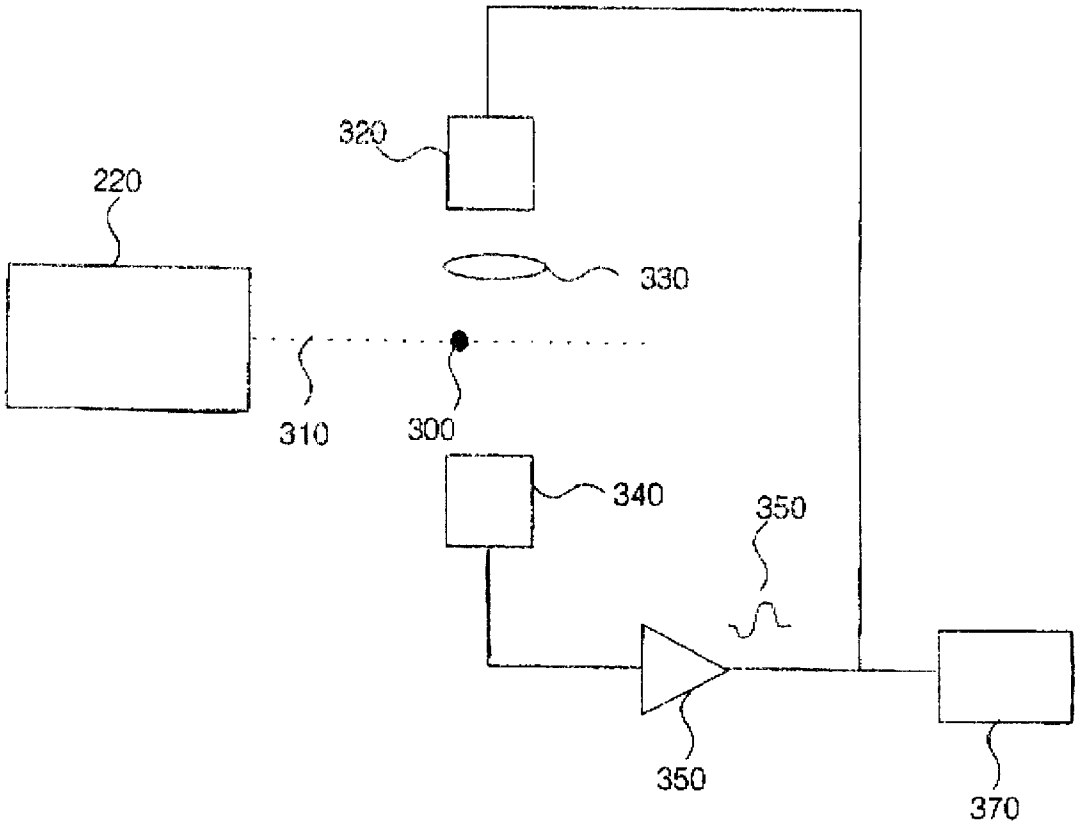
Fig. 1 (Prior Art)
Figure 2:
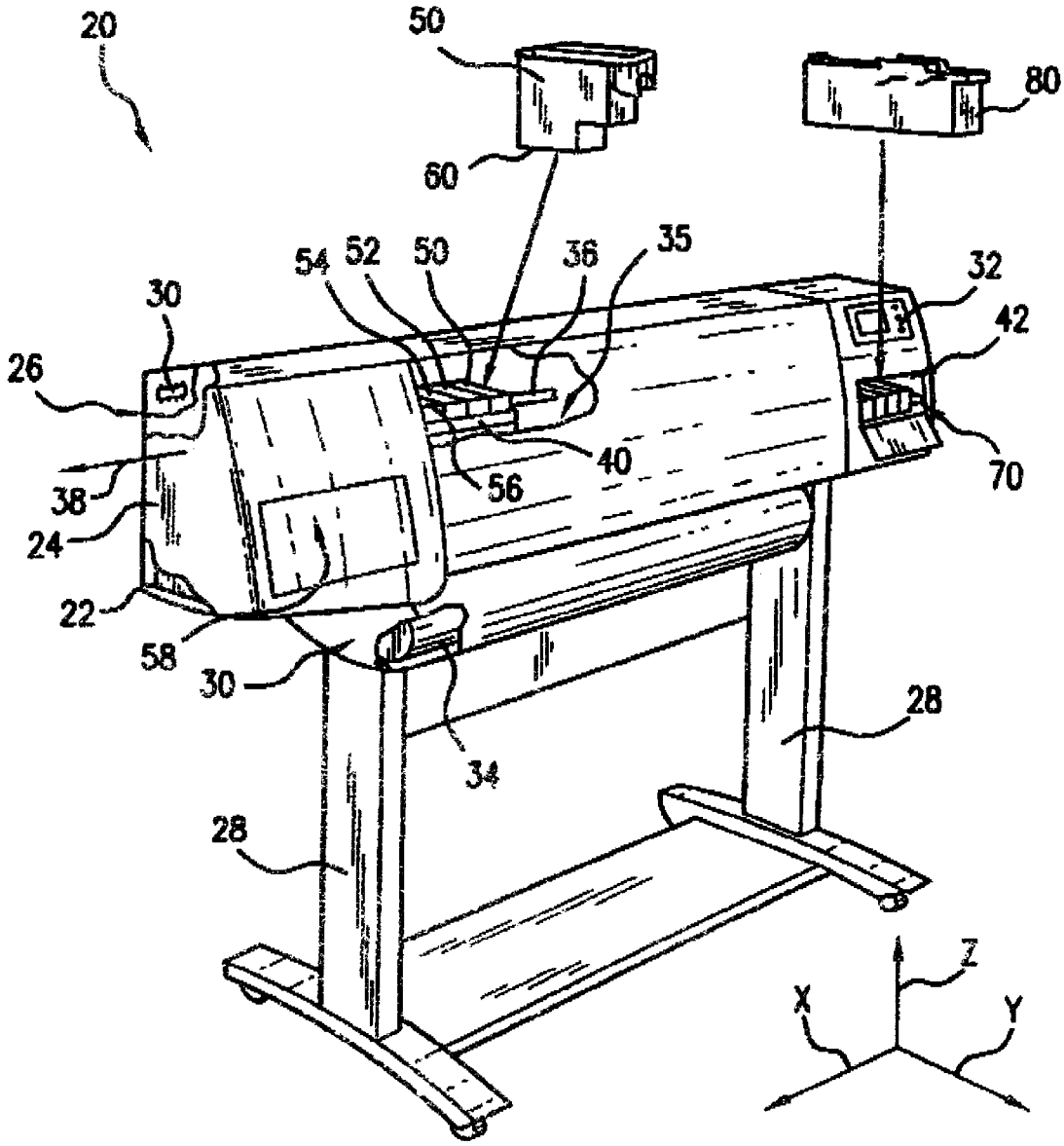
FIG. 2 illustrates an inkjet printing device including the present invention

FIG. 2 illustrates a first embodiment of an inkjet printing mechanism, here shown as an inkjet printer 20, constructed in accordance with the present invention, which may be used for printing conventional engineering and architectural drawings, as well as high quality poster-sized images, and the like, in an industrial, office, home or other environment. A variety of inkjet printing mechanisms are commercially available. For instance, some of the printing mechanisms that may embody the present invention include desk top printers, portable printing units, copiers, video printers, all-in-one devices, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller, illustrated schematically as a microprocessor 30, that receives instructions from a host device, typically a computer, such as a personal computer or a computer aided drafting (CAD) computer system (not shown). The printer controller 30 may also operate in response to user inputs provided through a key pad and status display portion 32, located on the exterior of the casing 24. A monitor coupled to the computer host may also be used to display visual information to an operator, such as the printer status or a particular program being run on the host computer. Personal and drafting computers, their input devices, such as a keyboard and/or a mouse device, and monitors are all well known to those skilled in the art.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip, for example, as described in U.S. Pat. No. 5,276,970, also assigned to Hewlett-Packard Company, the assignee of the present invention. The manner of providing positional feedback information via the encoder strip reader, may also be accomplished in a variety of ways known to those skilled in the art. Upon completion of printing an image, the carriage 40 may be used to drag a cutting mechanism across the final trailing portion of the media to sever the image from the remainder of the roll 34. Suitable cutter mechanisms are commercially available in DesignJet® 650C and 750C color printers. Of course, sheet severing may be accomplished in a variety of other ways known to those skilled in the art. Moreover, the illustrated inkjet printing mechanism may also be used for printing images on pre-cut sheets, rather than on media supplied in a roll 34.

In the printzone 35, the media sheet receives ink from an inkjet cartridge, such as a black ink cartridge 50 and three monochrome color ink cartridges 52, 54 and 56, shown in greater detail in FIG. 2. The cartridges 50–56 are also often called "pens" by those in the art. The black ink pen 50 is illustrated herein as containing a pigment-based ink. For the purposes of illustration, color pens 52, 54 and 56 are described as each containing a dye-based ink of the colors yellow, magenta and cyan, respectively, although it is apparent that the color pens 52–56 may also contain pigment-based inks in some implementations. It is apparent that other types of inks may also be used in the pens 50–56, such as paraffin-based inks, as well as hybrid or composite inks having both dye and pigment characteristics. The illustrated printer 20 uses an "off-axis" ink delivery system, having main stationary reservoirs (not shown) for each ink (black, cyan, magenta, yellow) located in an ink supply region 58. In this off-axis system, the pens 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "pen" or "cartridge" may also refer to replaceable printhead cartridges where each pen has a reservoir that carries the entire ink supply as the printhead reciprocates over the printzone.

The illustrated pens 50, 52, 54 and 56 have printheads 60, 62, 64 and 66, respectively, which selectively eject ink to from an image on a sheet of media 34 in the printzone 35. These inkjet printheads 60–66 have a large print swath, for instance about 20 to 25 millimeters (about one inch) wide or wider, although the printhead maintenance concepts described herein may also be applied to smaller inkjet printheads. The concepts disclosed herein for cleaning the printheads 60–66 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an orifice plate with a plurality of nozzles formed therethrough in a manner well known to those skilled in the art. The nozzles of each printhead 60–66 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

Figure 3:
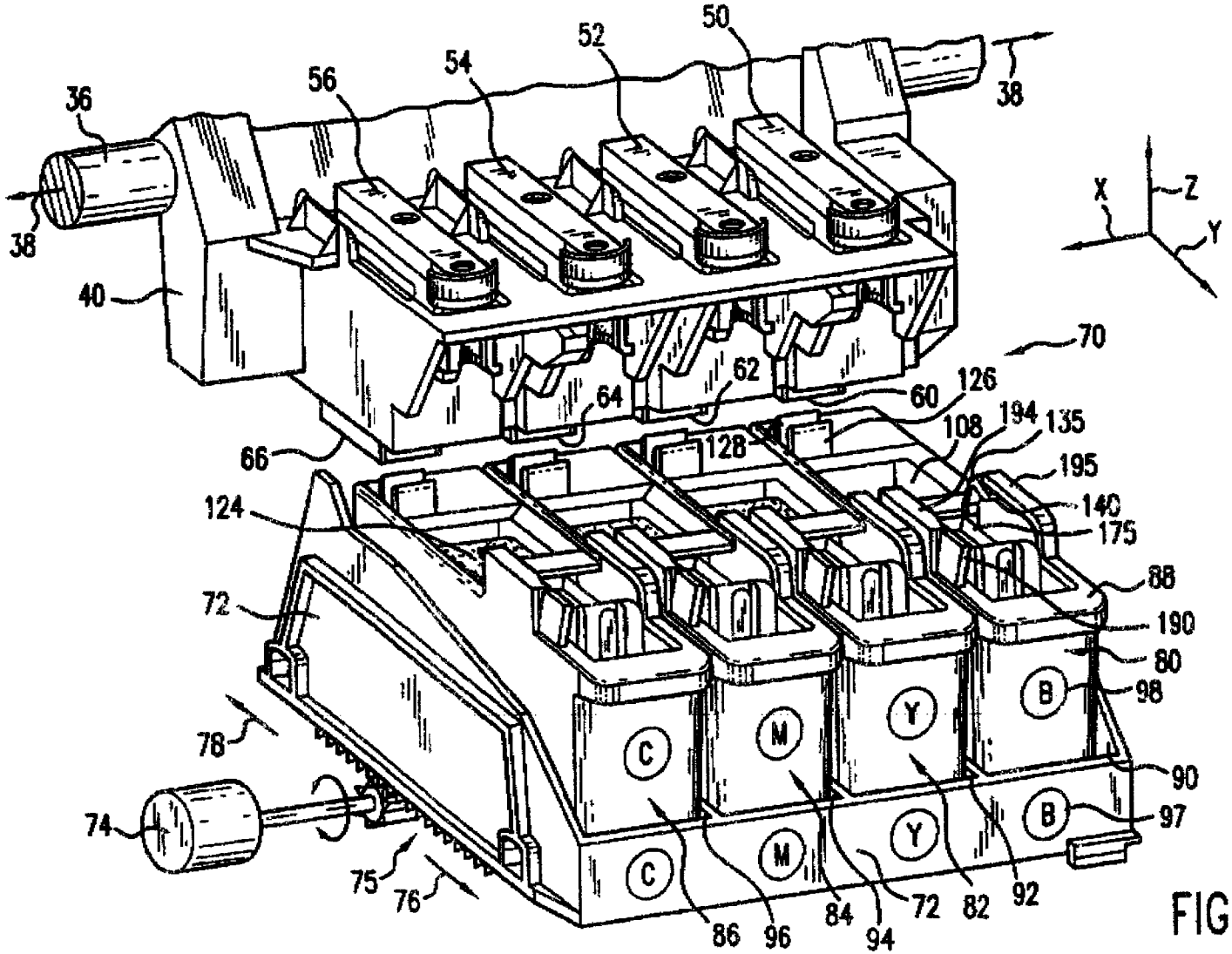
FIG. 3 illustrates more details of certain components included in the printing device of FIG. 1.

FIG. 3 shows the carriage 40 positioned with the pens 50–56 ready to be serviced by a replaceable printhead cleaner service station system 70, constructed in accordance with the present invention. The service station 70 includes a translationally moveable pallet 72, which is selectively driven by motor 74 through a rack and pinion gear assembly 75 in a forward direction 76 and in a rearward direction 78 in response to a drive signal received from the controller 30. The service station 70 includes four replaceable inkjet printhead cleaner units 80, 82, 84 and 86, constructed in accordance with the present invention for servicing the respective printheads 50, 52, 54 and 56. Each of the cleaner units 80–86 include an installation and removal handle 88, which may be gripped by an operator when installing the cleaner units 80–88 in their respective chambers or stalls 90, 92, 94, and the 96 defined by the service station pallet 72. Following removal, the cleaning units 80–86 are typically disposed of and replaced with a fresh unit, so the units 80–86 may also be referred to as "disposable cleaning units," although it may be preferable to return the spent units to a recycling centre for refurbishing. To aid an operator in installing the correct cleaner unit 80–86 in the associated stall 90–96, the pallet 72 may include indicia, such as a "B" marking 97 corresponding to the black pen 50, with the black printhead cleaner unit 80 including other indicia, such as a "B" marking 98, which may be matched with marking 97 by an operator to assure proper installation.

The cleaner unit 80–86 also includes a spittoon chamber 108. For the color cleaner units 82–86 the spittoon 108 is filled with an ink absorber 124, preferably of a foam material, although a variety of other absorbing materials may also be used. The absorber 124 receives ink spit from the color printheads 62–66, and the hold this ink while the volatiles or liquid components evaporate, leaving the solid components of the ink trapped within the chambers of the foam material. The spittoon 108 of the black cleaner unit 80 is supplied as an empty chamber, which then fills with the tar-like black ink residue over the life of the cleaner unit.

The cleaner unit 8086 includes a dual bladed wiper assembly which has two wiper blades 126 and 128, which are preferably constructed with rounded exterior wiping edges, and an angular interior wiping edge, as described in the Hewlett-Packard Company's U.S. Pat. No. 5,614,930. Preferably, each of the wiper blades 126, 128 is constructed of a flexible, resilient, non-abrasive, elastomeric material, such as nitrile rubber, or more preferably, ethylene polypropylene diene monomer (EPDM), or other comparable materials known in the art. For wipers a suitable durometer, that is, the relative hardness of the elastomer. may be selected from the range of 35–80 on the Shore A scale, or more preferably within the range of 60–80, or even more preferably at a durometer of 70+/−5, which is a standard manufacturing tolerance.

For assembling the black cleaner unit 80, which is used to service the pigment based ink within the black pen 50, an ink solvent chamber (not shown) receives an ink solvent, which is held within a porous solvent reservoir body or block installed within the solvent chamber. Preferably, the reservoir block is made of a porous material, for instance, an open-cell thermoset plastic such as a polyurethane foam, a sintered polyethylene, or other functionally similar materials known to those skilled in the art. The inkjet ink solvent is preferably a hygroscopic material that absorbs water out of the air, because water is a good solvent for the illustrated inks. Suitable hygroscopic solvent materials include polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have an almost zero vapor pressure. For the purposes of illustration, the reservoir block is soaked with the preferred ink solvent, PEG.

To deliver the solvent from the reservoir, the black cleaner unit 80 includes a solvent applicator or member 135, which underlies the reservoir block.

The cleaner unit 80–86 also includes a cap retainer member 175 which can move in the Z axis direction, while also being able to tilt between the X and Y axes, which aids in sealing the printheads 60–66. The retainer 175 also has an upper surface which may define a series of channels or troughs, to act as a vent path to prevent depriming the printheads 60–66 upon sealing, for instance as described in the allowed U.S. patent application Ser. No. 08/566,221 currently assigned to the present assignee, the Hewlett-Packard Company.

The cleaner unit 8086 also includes a snout wiper 190 for cleaning a rearwardly facing vertical wall portion of the printheads 60–66, which leads up to electrical interconnect portion of pens 50–56. The snout wiper 190 includes a base portion which is received within a snout wiper mounting groove 194 defined by the unit cover. While the snout wiper 190 may have combined rounded and angular wiping edges as described above for wiper blades 126 and 128, blunt rectangular wiping edges are preferred since there is no need for the snout wiper to extract ink from the nozzles. The unit cover also includes a solvent applicator hood 195, which shields the extreme end of the solvent applicator 135 and the a portion of the retainer member 175 when assembled.

Figure 4:
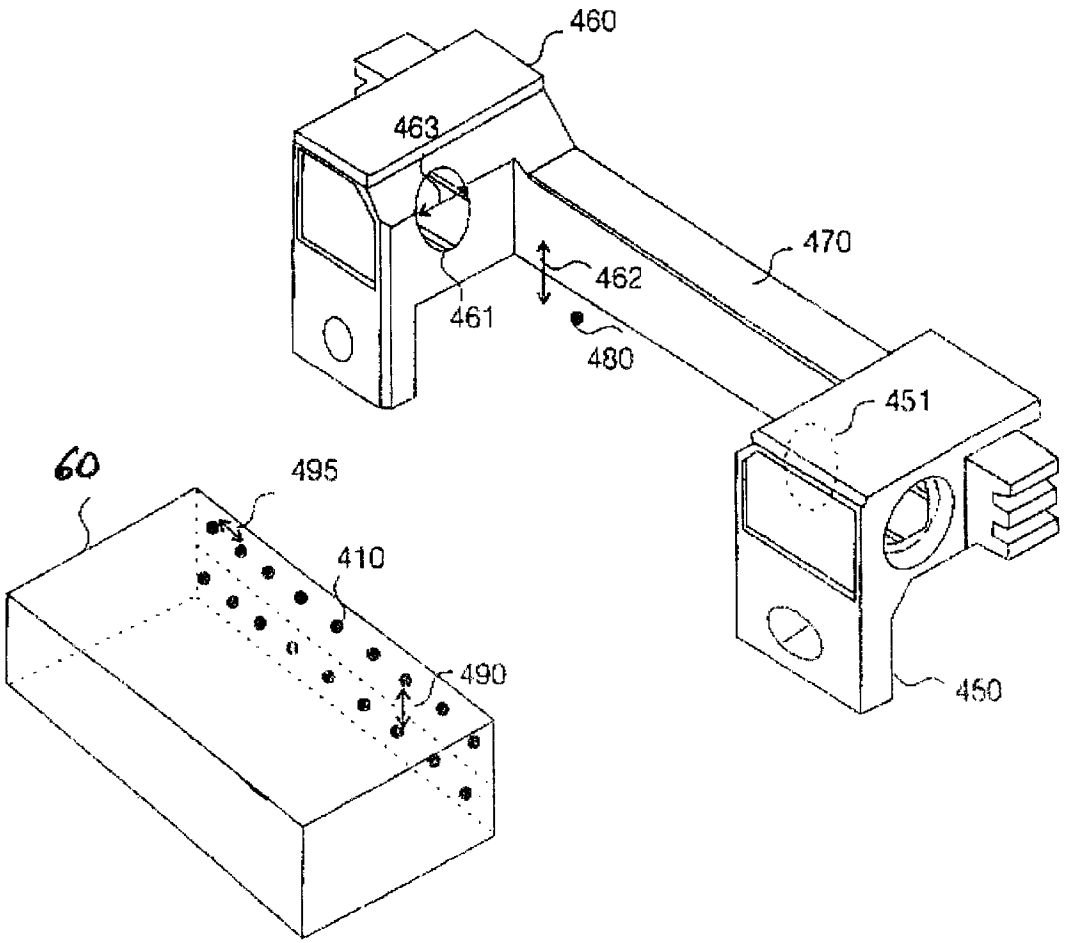
FIG. 4 illustrates an improved drop detection device according to a specific implementation of the present invention.

Referring to FIG. 4 herein, there is illustrated schematically a print head and improved drop detection device according to specific embodiments of the present invention. The print head 60 comprises an assembly of printer nozzles 410.

Preferably, the print head 60 is comprised of two rows of printer nozzles 410, each row containing 524 printer nozzles. According to a specific method of the present invention, the printer nozzles in a first row are designated by odd numbers and the printer nozzles in a second row are designated by even numbers. Preferably, a distance 490 between corresponding nozzles of the first and second rows is of the order 4 millimeters and a distance between adjacent printer nozzles 495 within a same row is 1/600 inches yielding a printed resolution of 600 dots per inch.

The print head 60 is configured, upon receiving an instruction from the printer, to spray or eject a single droplet of ink 480 from single nozzle of the plurality of nozzles.

Each nozzle 410 of the plurality of nozzles comprising print head 60 are, according to the best mode presented herein, configurable to release a sequence of ink droplets in response to an instruction from the printer device. In addition to the print head 60, there is also included an ink droplet detection means comprising a housing 460 containing an high intensity infra-red light emitting diode; a detector housing 450 containing a photo diode detector and a elongate, substantially straight rigid member 470. The emitter housing 460, bar 470 and detector housing 450 all comprise a rigid locating means configured to actively locate the high intensity infra-red light emitting diode with respect to the photo diode detector.

The print head 60 and the rigid locating means 460, 470 and 450 are orientated with respect to each other such that a path traced by an ink droplet 480 ejected from a nozzle of the plurality of nozzles comprising the print head 60 passes between emitter housing 460 and detector housing 450.

The high intensity infra-red light emitting diode contained within emitter housing 460 is encapsulated within a transparent plastics material casing. The transparent plastics material casing is configured so as to collimate the light emitted by the light emitting diode into a light beam. According to the best mode described herein, the collimated light beam emitted by the high intensity infra-red LED contained within emitter housing 460 exits the emitter housing via aperture 461. The collimated light beam from emitter housing 460 is admitted into detector housing 450 by way of aperture 451. The light beam admitted into detector housing 450 illuminates the photo diode detector contained within detector housing 450. An ink droplet 480 ejected from a nozzle 410 entering the collimated light beam extending between apertures 461 and 451 causes a decrease in the amount of light entering aperture 451 and hence striking the photo diode contained with detector housing 450. Ink droplets are only detected if they pass through an effective detection zone in the collimated light beam which has a narrower width than a width of the collimated light beam. Preferably, the width of the effective detection zone 462 is 2 millimeters. A width 463 of the emitter housing aperture 461 and a same width of the detector housing aperture 451 are preferably 1.7 millimeters.

Figure 5:
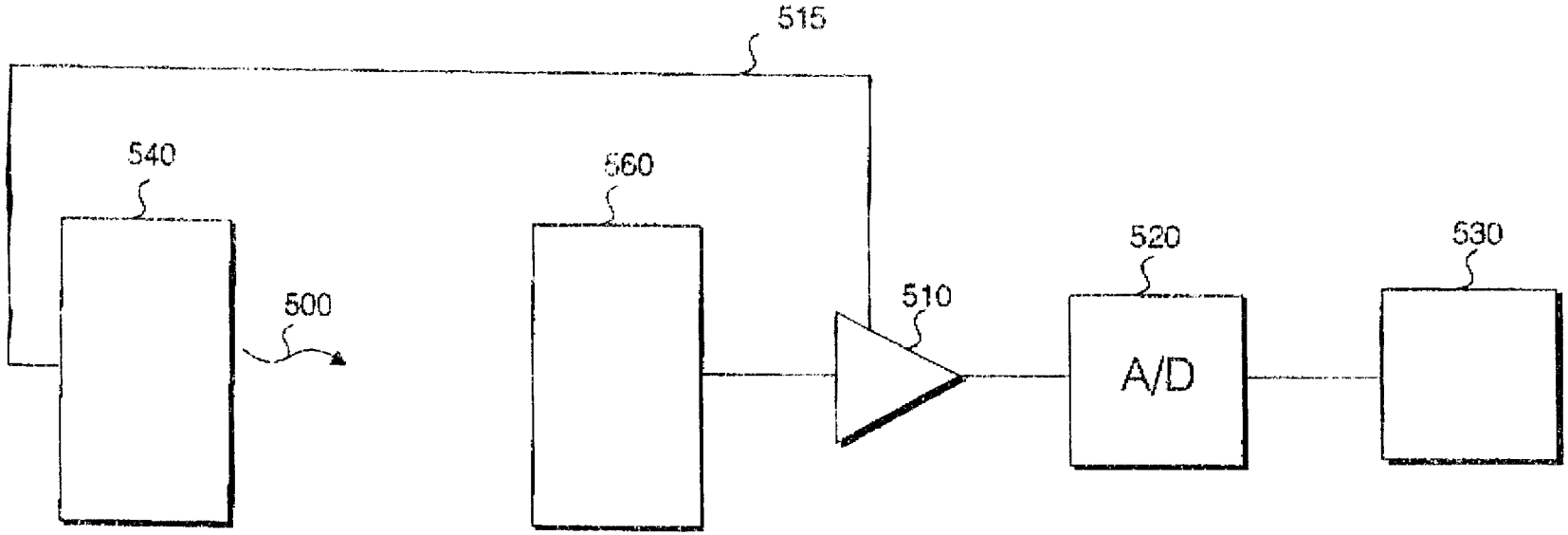
FIG. 5 illustrates schematically an overview of the functional blocks of the improved drop detection according to a specific method of the present invention.

Referring to FIG. 5 herein, there is illustrated schematically the functional blocks comprising the improved drop detection according to the best mode presented herein. High intensity infra-red LED 540 emits light 500 which is absorbed by photo diode detector 560. The output current of the photo diode detector 560 is amplified by amplifier 510. Additionally, amplifier 510 is configured to increase a driver current to high intensity infra-red LED 540 in response to a decrease in an output current of the photo diode detector 560 and to decrease an input current into high intensity infra-red LED 540 in response to an increase in the output current of photo diode detector 560 via signal path 515. An amplified output current of amplifier 510 is then input into an analogue to digital (A/D) converter 520. The AND converter 520 samples the amplified output of the photo diode. Preferably, the AID converter 520 samples the amplified output current 64 times with a sampling frequency of 40 kilohertz. The period between samples is, preferably, 25 $\mu$s yielding a total sampling time of 1.6 milliseconds. The 64 samples of the output of the photo diode 560 are stored within a memory device in drop detection unit 530.

According to the best mode presented herein, drop detection unit 530 processes the sampled output current of the photo diode detector 560 to determine whether or not an ink droplet has crossed the collimated light beam between the high intensity infrared LED 540 and the photo diode detector 560.

Analysis of the output current of the photodiode detector 560 enables operating characteristics of the printer nozzles to be determined.

Drop detection unit 530 may also be configured to store in a memory device an indication of whether or not a nozzle of the plurality of nozzles comprising print head 60 is "good" of "bad".

According to the best mode presented herein, before printing a page the printer device checks the nozzles comprising print head 60 by performing a sequence of operations which are known hereinafter as drop detection.

In a first mode, in the following also called individual method, each nozzle within a row of nozzles in turn ejects a predetermined sequence of ink droplets such that only one nozzle is ejecting ink droplets at any time. Each nozzle within the plurality of nozzles comprising the print head are uniquely identified by a number. Preferably, a first row of nozzles are identified by a contiguous series of odd numbers between 1 and 523 and a second row of nozzles are identified by a contiguous series of even numbers between 2 and 524. During drop detection the odd numbered nozzles within a row each ejects a predetermined sequence of ink droplets and then the print head 60 is moved to bring the second row of nozzles in line with the effective detection zone 462. Each even numbered nozzle, in turn, ejects a same predetermined sequence of ink droplets.

In the enhanced embodiment, nozzles in each row are grouped into subgroups containing a plurality of nozzles, preferably contiguous. More preferably each subgroup contains a pair of contiguous nozzles. During drop detection each group of nozzles in turn ejects a predetermined sequence of droplets, such that only such group of nozzles is ejecting ink droplets at any time.

In the following it is described first how the drop detection works when each nozzle is checked individually and only an individual nozzle is ejecting a sequence of droplets at any time. Further on, it will be described how the enhanced embodiment of checking more than a nozzle at any time can be implemented, to speed up the detection process, and how the two modes can work together.

In order to maximize the signal output of the photo diode detector the pre-determined sequence of ink droplets are timed such that all of the ink droplets within the pre-determined sequence are within the collimated light beam at substantially the same moment. In order to produce a signal at the output of the photo diode detector 560 which is distinguishable from the background noise there is a minimum volume of ink which must be simultaneously occulting the collimated light beam. Preferably, the total volume of the ink droplets simultaneously located within the collimated light beam is in the range 30 to 100 pl. Hence, in a monotone pen of a printer which produces an ink droplet having a volume of 35 pl the pre-determined sequence comprises 2 ink droplets separated by a period of 83 $\mu$s. The operation of ejecting a pre-determined sequence of ink droplets is also known as "spitting". The time duration of 83 $\mu$s corresponds to a spitting frequency of 12 kilohertz. The spitting frequency is also known herein as an ejection frequency. In printer devices configured to produce color prints, each ink droplet has a volume of 11 picolitres and hence the number of droplets required lie simultaneously within the collimated light beam is for yielding a total ink droplet volume in the light beam of 44 picolitres. Preferably, the spitting frequency for ink droplets in printer devices configured to produce color prints is 12 kilohertz. It will be understood by those skilled in the art that a general method disclosed herein may be applied to printer devices having different ink droplet volumes and spitting frequencies.

Figure 6:
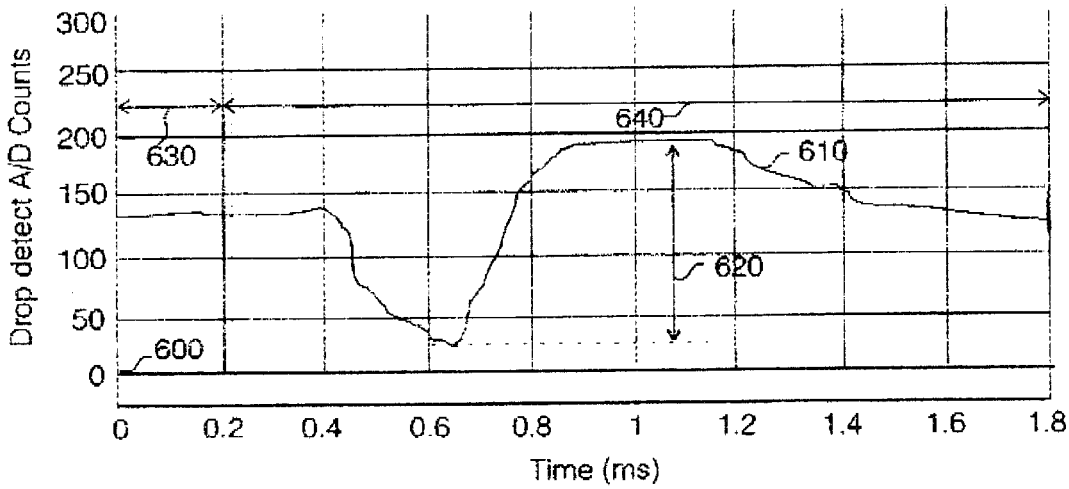
FIG. 6 illustrates, by way of example, an output signal of a drop detection device according to a specific implementation of the present invention prior to analogue to digital conversion.

Referring to FIG. 6 herein there is illustrated graphically, by way of example, an output of A/D converter 520 illustrating a signal 610 produced by a single droplet of the predetermined sequence of ink droplets crossing the collimated light beam between the high intensity infra-red LED 540 and the photo diode 560.

Referring to FIG. 6, at time 0 milliseconds (ms) a first droplet of a pre-determined sequence of droplets is ejected from a nozzle. After a delay of 0.2 ms to allow the droplets to travel from the nozzle to the collimated light beam. The AND converter 520 commences sampling the amplified output of the photo diode detector 560. The time delay of 0.2 ms is also known as fly time. From approximately 0.4 to 0.6 ms the output of the photo diode detector 560 drops as the predetermined sequence of ink droplets block light entering the photo diode. At approximately 0.65 ms the sampled output of the photo diode detector 560 increases in response to an increased input current into high intensity infra-red LED 540 as a result of a decreased output current of photo diode detector 560 as described herein before. The analogue output signal of amplifier 510 is sampled periodically at a sampling frequency in the range 30 kHz to 50 kHz, and preferably at 40 kHz by the analogue to digital convertor 520. Drop detection unit 530 inputs a stream of 64 digital samples of variable amplitude representing the pulse signal 510 resulting from the passage of the ink drop past the detector. Quantization of the amplitude element of the pulse signal may be implemented in A/D convertor 520, or in drop detector 530, to produce a measure of amplitude of each sample of the 64 samples of the single pulse signal resulting from the ink drop. The peak-to-peak signal 620 corresponds to a difference between a highest number of counts sampled and a lowest number of counts sampled, where a count is a quantization unit of current or voltage of the detector output signal. Preferably, the A/D convertor 520 quantizes the current or voltage of the detector output signal into an 8-bit digital signal. Hence, according to the best mode presented herein, the current or voltage of the detector output signal may be represented by a maximum of 256 counts.

A nozzle is determined to be functioning correctly if, after ejecting from the nozzle one or a plurality of ink droplets in a pre-determined sequence, the peak-to-peak signal level resulting from one or a plurality of ink droplets is greater than a threshold value. It is important to choose a threshold level which lies outside the range of the natural variability of the measured peak-to-peak amplitude variation of the detector output 620 and which also lies outside the range of the variability in the noise introduced into the system by, for example, the photo diode 560 and amplifier 510.

Figure 7:
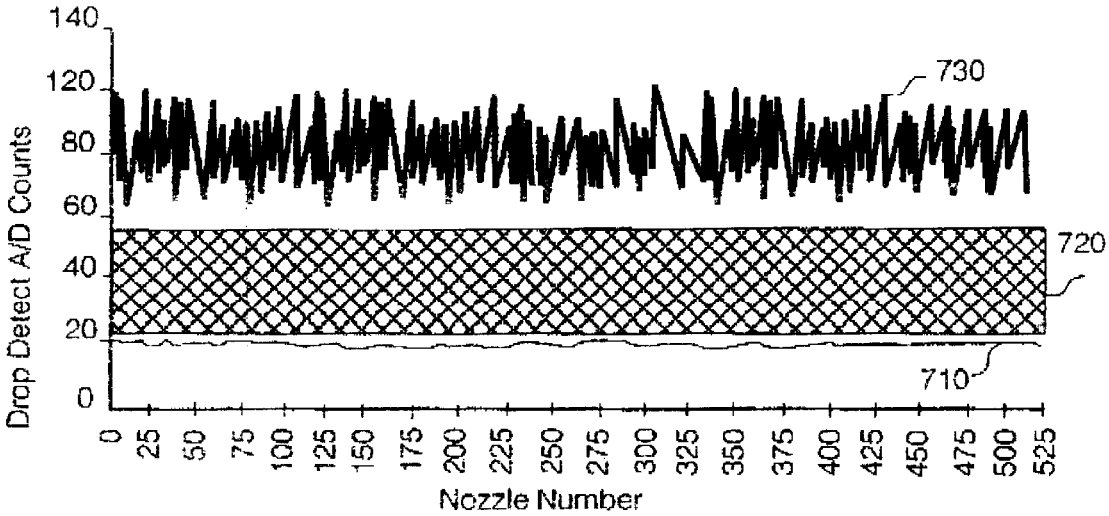
FIG. 7 illustrates graphically a region which falls within the drop detection reliability specification (hatched region); the drop detection peak to peak signal (thick line); and the noise peak to peak signal (thin line) according to a specific implementation of the present invention.

Referring to FIG. 7 herein, there is illustrated graphically typical A/D counts for peak-to-peak signals 730 for the plurality of nozzles comprising a print head, an average noise level for noise introduced by the photo diode, etc 710 and a hatched region 720 representing the range of threshold values which could be used in the drop detection algorithm. The plotted line 730 represents for each nozzle a peak to peak amplitude of one or more signals corresponding to one or more ink droplets ejected from the nozzle. In an optimum implementation, an objective is to obtain a reliable peak to peak reading from a single signal pulse, generated by passage of a single ink droplet ejected from a nozzle, so that a reliable print head test can be obtained from just one ink droplet per nozzle being ejected. Thus, in the example nozzle characteristic of FIG. 7, ideally the plotted line 730 of the peak to peak signals for a 525 nozzle print head would be produced by 525 ink droplets (one per nozzle) and 525 corresponding pulse signals 610, each sampled into 64 quantized samples. However, the signal to noise ratio of the detected signal for a single droplet depends upon the volume of the ink droplet. The larger the ink droplet, the better the signal to noise ratio. To achieve improved reliability at the expense of speed of testing, the print head characteristic 730 may be produced by, for each nozzle, averaging the peak to peak signal of a plurality of pulses produced by a corresponding plurality of droplets ejected from the nozzle. In the individual method herein, two pulses per print nozzle are ejected in a test sequence, so for a 525 nozzle print head, the print head characteristic 730 is produced by analysing 1050 ink droplets each of volume 35 picoliters. Alternatively, reducing the droplet volume to 11 picoliters, 4 ink droplets per nozzle need to be ejected and detected to determine an average peak to peak pulse response signal for each nozzle.

Thus, for 11 picoliter droplets, for a 525 nozzle array, 2100 individual ink droplets are ejected in a test sequence, 4 per nozzle, to provide a print head characteristic 730, which is sufficiently separated from the background noise, in which the peak to peak signal for each nozzle is determined from a plurality of signal pulses produced by a plurality of ink droplets ejected from the nozzle.

Preferably, the threshold value of the peak-to-peak number of counts used to determine whether a nozzle is functioning correctly or not is 45 A/D counts. This threshold value is established by using the following constraints:

1. The probability of incorrectly detecting a good drop from the noise level is less than 0.001 parts per million.

To achieve this specification the threshold level should preferably be set at least six standard deviations above the average noise level. This yields a minimum threshold level of approximately 25 A/D counts.

2. The probability of incorrectly missing a correctly functioning nozzle is less than one part per million. In order to achieve this specification the threshold level must lie below the mean peak-to-peak signal level by five standard deviations. This yields a maximum threshold level of approximately 55 A/D counts.

Hence, the choice of threshold level of 45 A/D counts lies approximately mid-way between a maximum and a minimum threshold level, where said maximum and minimum values are calculated assuming that both the noise level and peak-to-peak counts are normally distributed.

Referring to Table 1 there are summarised important parameters according to the individual method described herein.

TABLE 1

| Drop Detect Algorithm Parameter | Value |
|---|---|
| Number of drops fired per nozzle | 2 × 35 pl/4 × 11 pl |
| Spitting frequency | 12 kHz |
| Signal Sampling frequency | 40 kHz |
| Total number of samples | 64 |
| Fly time | 0.2 ms |
| Detection threshold | 45 A/D |

Figure 8:
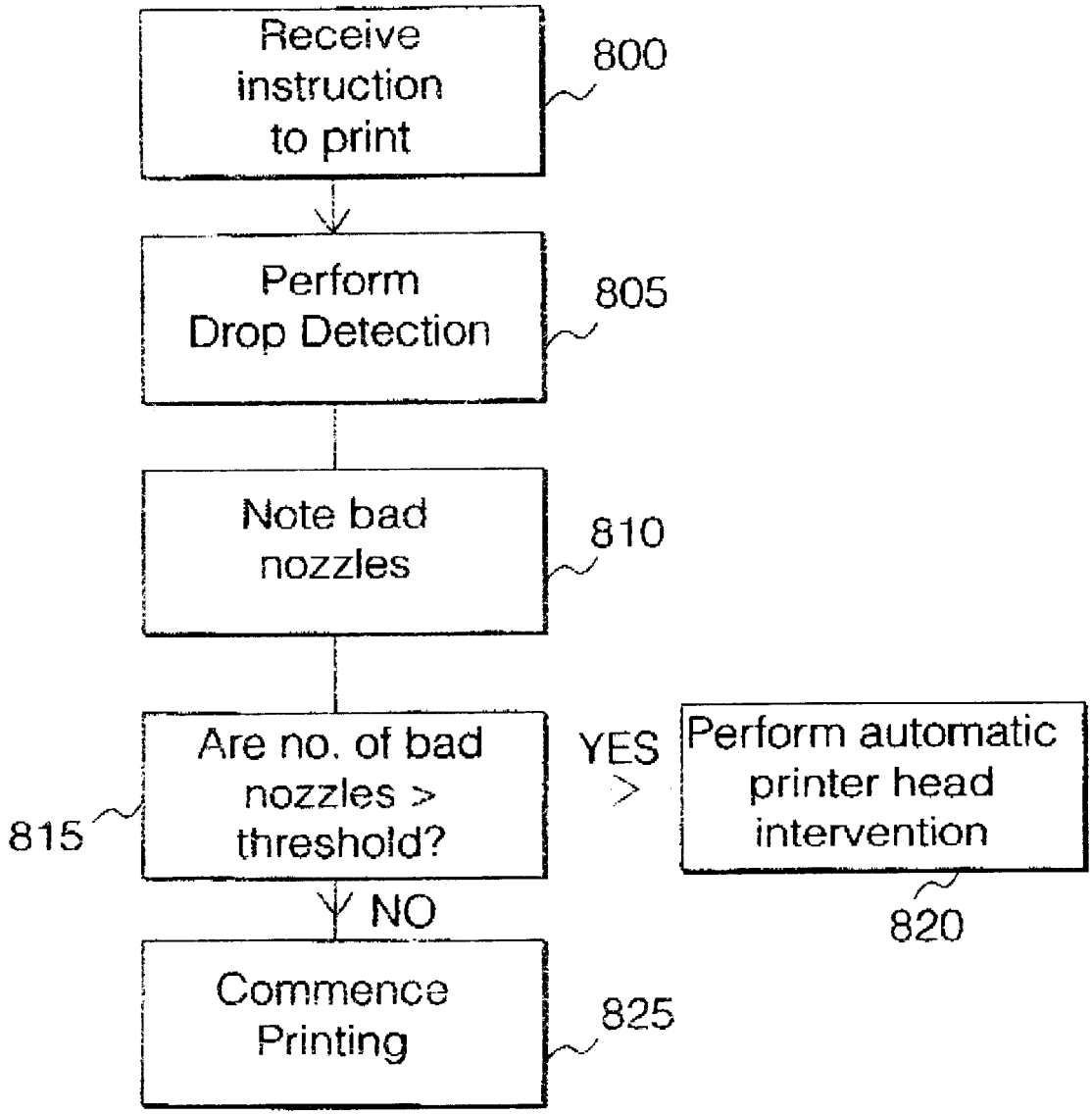
FIG. 8 illustrates schematically generalized process steps involved in drop detection performed before printing a page according to a specific method of the present invention.

Referring to FIG. 8 herein there is illustrated schematically a block diagram of the steps that occur when a printer device receives an instruction signals to print according to the individual method described herein. It will be appreciated that the print head is controlled by a series of signals generated by a print head driver device. The print head driver device comprises a processor and associated memory, operating in accordance with a set of algorithms. The algorithms may be implemented either as hardware operating in accordance with programmed instructions stored in memory locations, or as firmware in which the algorithms may be explicitly designed into a physical layout of physical components. The process steps are described herein in a manner which is independent of their particular physical implementation, and the physical implementation of such process steps will be understood by those skilled in the art. In step 800, the printer device receives an instruction to print a page. In step 805, the printer performs a drop detection procedure which comprises ejecting a pre-determined sequence of ink droplets from each nozzle in turn when attempting detect the ejected ink droplets. In step 810, the identifying numbers of nozzles which are found not to function correctly during drop detection which are also known as "bad" nozzles are stored in a memory device. In step 815, if the number of bad nozzles is greater than a threshold number then in step 820 the printer device performs an automatic print head intervention. Performing automatic print head intervention 820 may comprise increased cleaning of the bad nozzles in an attempt to recover them. In addition, step 820 may further comprise steps generating error hiding information by which, during a print operation, good nozzles are re-used to eject a predetermined sequence of ink droplets in the place of non-functioning nozzles thereby improving print quality. If, in step 815, the number of bad nozzles is less than a same threshold number then, in step 825, the printer device commences printing. Preferably, said step of performing automatic print head intervention 820 is initiated if, during a last fixed number of drop detections, the number of bad nozzles was greater than the threshold level. Preferably, the fixed number of previous drop detections may be 8, 16 or 64.

Figure 9:
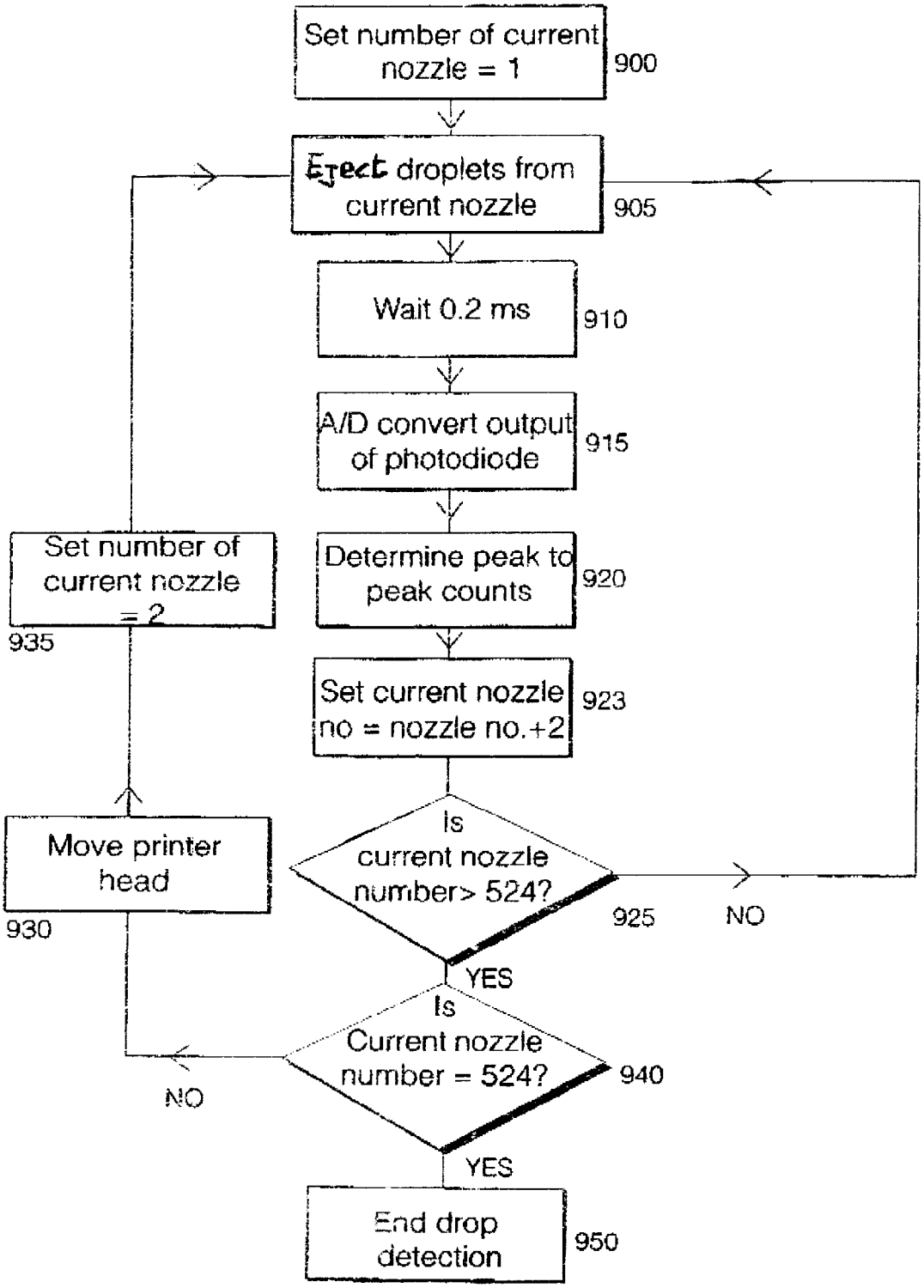
FIG. 9 illustrates schematically in more detail steps involved in drop detection according to a specific method of the present invention.

Referring to FIG. 9 herein, there is illustrated schematically a block diagram of the steps comprising drop detection step 805. In step 900, a number identifying a current nozzle of the plurality of nozzles of the print head to be tested using drop detection is set to equal 1. In step 905 the current nozzle is instructed to eject a pre-determined sequence of droplets. Preferably, as described herein before, for a printer configurable to produce monotone output the pre-determined sequence comprises two droplets separated in time by a period of 83 $\mu$s. Preferably, where the printer device is configurable to produce color output the pre-determined sequence comprises four droplets spaced apart by a same duration of time of 83 $\mu$s. In step 910, there is a delay of 0.2 milliseconds which commences from substantially the same moment of time that a first droplet of the pre-determined sequence of droplets leaves the current nozzle. This delay enables the droplets to enter the infra-red light beam extending between emitter housing 460 and receiver housing 450 before measuring the output of the photo diode detector 560. This delay time is also known as "fly" time. In step 915 the A/D converter 520 measures an amplified output of photo diode detector 560. Preferably, the AID converter 520 samples the amplified output of the photo diode detector 560 64 times with a same time duration of 25 $\mu$s between each measurement. This corresponds to a signal sampling frequency of 40 kilohertz. In step 920, the samples are processed using an algorithm to determine the peak-to-peak counts, which are used to discriminate between detection and non-detection of ink droplets ejected from the current nozzle. Each nozzle receives a drive signal causing the nozzle to release a number of ink droplets corresponding to a predetermined volume of ink, preferably in the range 30 to 100 picoliters. The volume of ink is selected such that either a single ink droplet of at least the predetermined volume produces a detector signal having sufficient signal to noise ratio to reliably determine detection of the drop, and/or such that a series of two or more droplets having a combined volume which is at least the predetermined volume result in a series of detected signal pulses which when analyzed together, have a signal to noise ratio sufficient to reliably determine satisfactory operation of the nozzle. It has been found experimentally as described hereinabove in this specification, that in the enhanced embodiment a predetermined volume of around 70 picoliters divided into two consecutively released droplets is optimum for characterizing a nozzle releasing black ink, and a predetermined volume of around 44 picoliters contained as 4 consecutively released droplets is optimum for characterizing a nozzle releasing coloured ink, of a colour other than black. In step 923, the number identifying the current nozzle is incremented by 2. By this means, the nozzle number 1, 3, 5, . . . , 523 comprising the first row are tested for correct functionality according to the individual method presented herein. In step 925, if the number identifying the current nozzle is less than 524 then steps 905 to 925 are repeated for the next nozzle. In step 940, if the number identifying the current nozzle is 524 then the perform drop detection step 805 is completed. Otherwise; in step 930, the print head 60 is moved so as to ensure that droplets ejected from the second row of even numbered nozzles passes through the effective detection zone of the infra-red light beam. In step 935, the number identifying the current nozzle is set equal to 2 and steps 905 to 925 are repeated for the even numbered nozzles comprising the second row of the print head.

Figure 10:
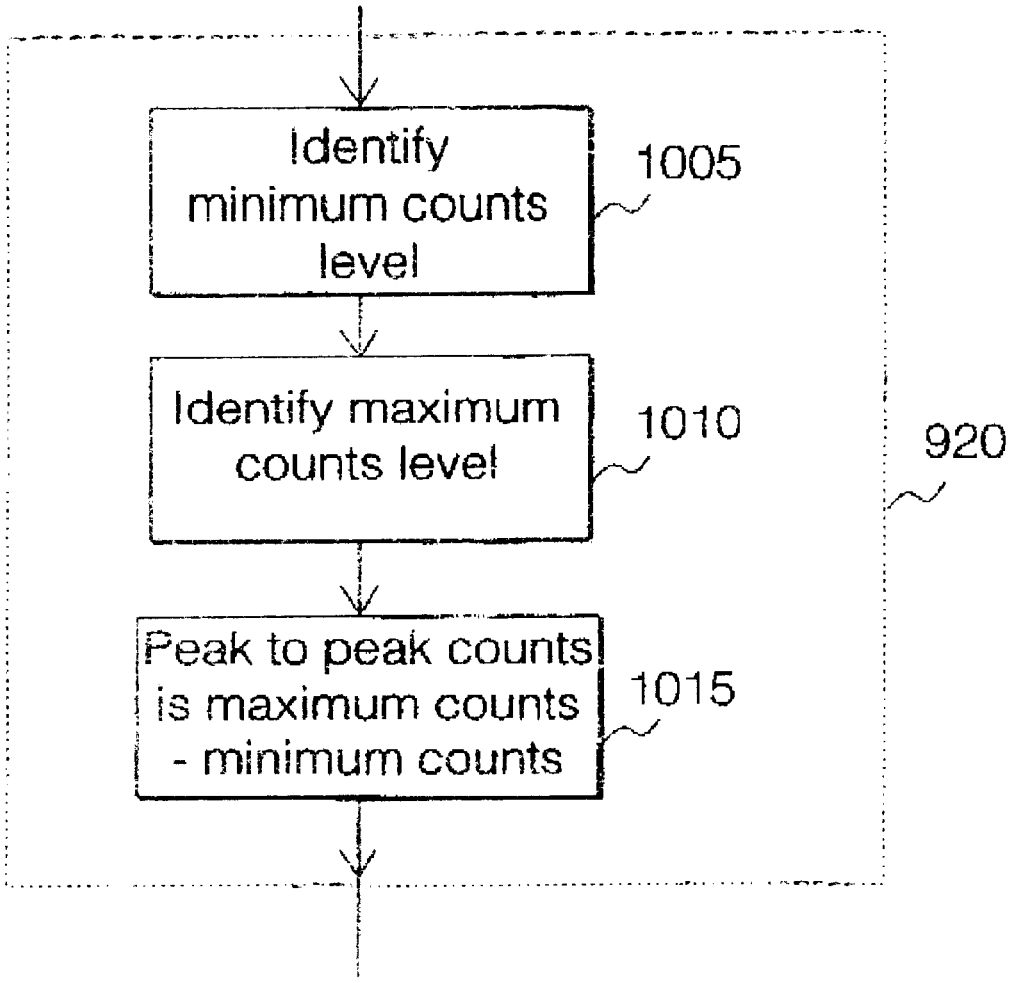
FIG. 10 illustrates schematically in more detail further steps involved in drop detection according to a specific method of the present invention.

Referring to FIG. 10 herein, there is illustrated schematically a flow diagram showing in more detail the steps involved in step 920 of FIG. 9. In step 1005, a minimum count level sampled by the A/D converter 520 sampling the output of photo diode 560 is identified. In step 1010, a maximum count level corresponding to the peak output from the photo diode detector 560 is identified. In step 1015, the peak-to-peak counts are calculated by forming a difference between the maximum count level and the minimum count level. In the individual method herein, this processing is performed by an Application Specific Integrated Circuit (ASIC) operating instructions stored in a read only memory.

Referring to Table 2 herein there are summarised the minimum detection times required to check the 524 nozzles comprising a print head. The total time required to check pen comprising 524 nozzles within a printer device configured to print monotone plots is of the order 2 seconds. Approximately 1 second is required to move the nozzles into position with respect to the drop detect unit and a further period of approximately 1 second is required to perform drop detection on the 524 nozzles. Similarly, the time required for the improved drop detection method and apparatus to test the 2096 nozzles corresponding to 4 color pens within a printer device configured to produce color plots is of the order 1+4=5 seconds. This represents a significant improvement over prior art drop detection methods where, typically, 25 seconds was required to assess 600 nozzles.

TABLE 2

| Drop Detect Throughput | Seconds |
|---|---|
| Monotone Plots (1 pen) | 2 |
| Color Plots (4 pens) | 5 |

However, when the number of nozzles to check increases the individual method has a response time which is increasing considerably. In an embodiment having for instance 24 pens, the total time required for checking all the nozzles will not be less than 25 second, in accordance to the above description.

According to the best mode of the present inventions, in an enhanced embodiment first nozzles in each row are grouped into subgroups containing a plurality of nozzles, In the following for sake of simplicity, only the preferred embodiment of subgroups containing 2 contiguous nozzles in the same row will be described. The skilled in the art may appreciate that the same applies to subgroups of nozzles containing any number of nozzles, preferably having no more than 4 nozzles each.

During drop detection each pair of nozzles in turn ejects a predetermined sequence of droplets, such that only such pair of nozzles is ejecting ink droplets at any time.

The drop detector described above will not be capable of distinguish which of the two nozzles is firing or not firing, however in this case the information carried by a signal generated by the drop detector is still valuable.

In fact the signal can be compared with two threshold values one much grater than the other. If the signal is higher than the first threshold this means that both the nozzles of the pair are working, if the signal is lower than the second threshold this means that both the nozzles are not firing, if the signal is comprised between the first and the second thresholds it means that one of the two nozzles is working while the other is failing.

The method used to generate the signal is very similar to the one already described above.

In a first embodiment the predetermined sequence of z droplets to be fired by a single nozzle is split between the two nozzles. This means that nozzle n fires a sequence of z/2 droplets and nozzle n+2 fires in sequence another sequence of z/2 droplets.

As in the individual method, in order to maximize the signal output of the photo diode detector the pre-determined sequence of ink droplets are timed such that all of the ink droplets within the predetermined sequence are within the collimated light beam at substantially the same moment. In order to produce a signal at the output of the photo diode detector 560 which is distinguishable from the background noise there is a minimum volume of ink which must be simultaneously occulting the collimated light beam. Again the total volume of the ink droplets simultaneously located within the collimated light beam is in the range 30 to 100 pl. Hence, in a monotone pen of a printer which produces an ink droplet having a volume of 35 pl the pre-determined sequence comprises 2 ink droplets separated by a period of 83 $\mu$s. The operation of ejecting a pre-determined sequence of ink droplets is also known as "spitting". The time duration of 83 $\mu$s corresponds to a spitting frequency of 12 kilohertz. The spitting frequency is also known herein as an ejection frequency. In printer devices configured to produce color prints, each ink droplet has a volume of 11 picolitres and hence the number of droplets required lie simultaneously within the collimated light beam is for yielding a total ink droplet volume in the light beam of 44 picolitres. Preferably, the spitting frequency for ink droplets in printer devices configured to produce color prints is 12 kilohertz.

This means that in case of color pens, a pair of nozzles ejects a sequence of 4 droplets, each nozzle spitting 2 droplets.

According to the enhanced embodiment, the technique for obtaining a number of A/D counts for peak-to-peak signal of a drop detections applied to the pair of nozzles is again the one described above with reference to FIGS. 6 and 7.

In this case the lower threshold level shall lie outside the range of the natural variability of the measured peak-to-peak amplitude variation of the detector output 620 and which also lie outside the range of the variability in the noise introduced into the system.

Preferably, according to this embodiment, the threshold value of the peak-to-peak number of counts, which is used to determine whether both nozzles are not functioning correctly, is to 45 A/D counts or less. The upper threshold value of the peak-to-peak number of counts which is used to determine whether both nozzles are functioning correctly, is 55 A/D counts or more. More preferably the upper threshold value is 65 A/D or more.

All the peak-to-peak number of count comprised between the upper threshold and the lower threshold identifies unknown pairs of nozzles, which have one nozzle functioning correctly and the other non-functioning correctly.

In this case further investigation are required to identify which is the failing and which is the working nozzles. Preferably a drop detection, in accordance to the individual method as in FIGS. 9 and 10, will be performed limited to the unknown pairs of nozzles to identify which are the failing nozzles and which the working ones.

Figure 11:
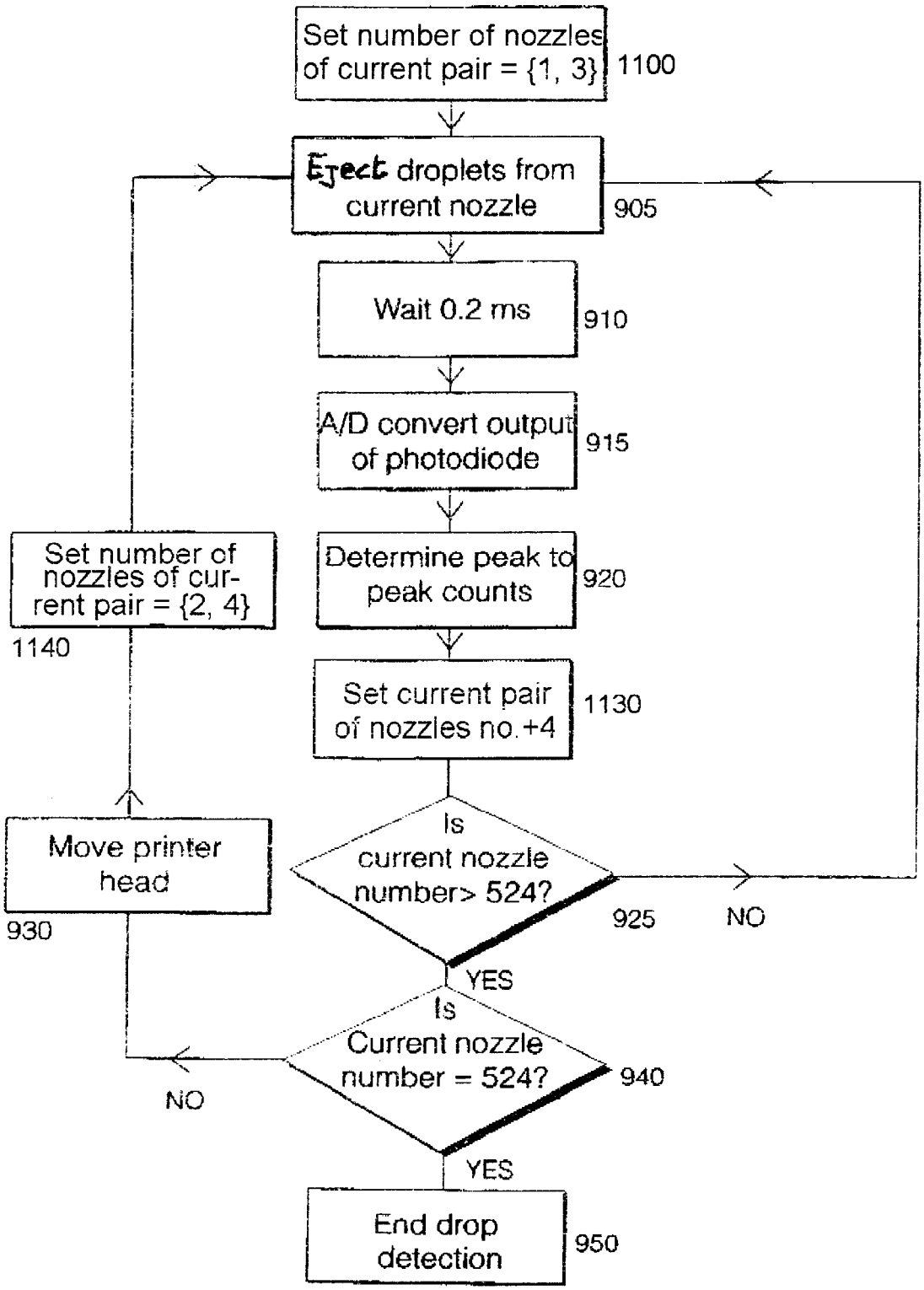
FIG. 11 illustrates schematically in more detail steps involved in drop detection according to another method of the present invention

Referring to FIG. 11 herein, there is illustrated schematically a block diagram of the steps comprising drop detection step 805, according to the enhanced embodiment. In the following diagram the same numbering has been maintained for these steps which remains unchanged when moved from the individual method to the enhanced embodiment. In step 1100, a number identifying a current pair of nozzles of the plurality of pairs of nozzles of the print head to be tested using drop detection is set to equal {1, 3}, i.e. the pair includes contiguous nozzles number 1 and 3. In step 905 each nozzles in the current pair is instructed to eject a pre-determined sequence of droplets. Preferably, as described herein before, for testing a colour pen the pre-determined sequence comprises two droplets separated in time by a period of 83 μs from each nozzle. In step 910, there is a delay of 0.2 milliseconds which commences from substantially the same moment of time that a first droplet of the pre-determined sequence of droplets leaves the current nozzle. This delay enables the droplets to enter the infra-red light beam extending between emitter housing 460 and receiver housing 450 before measuring the output of the photo diode detector 560. This delay time is also known as "fly" time. In step 915 the AND converter 520 measures an amplified output of photo diode detector 560. Preferably, the AND converter 520 samples the amplified output of the photo diode detector 560 64 times with a same time duration of 25 μs between each measurement. This corresponds to a signal sampling frequency of 40 kilohertz. In step 920, the samples are processed using an algorithm to determine the peak-to-peak counts, which are used to discriminate between detection and non-detection of ink droplets ejected from the current nozzle. Each pair of nozzles receives a drive signal causing the nozzle to release a number of ink droplets corresponding to a predetermined volume of ink, preferably in the range 30 to 100 picoliters. The volume of ink is selected such that either a single ink droplet of at least the predetermined volume produces a detector signal having sufficient signal to noise ratio to reliably determine detection of the drop, and/or such that a series of two or more droplets having a combined volume which is at least the predetermined volume result in a series of detected signal pulses which when analyzed together, have a signal to noise ratio sufficient to reliably determine satisfactory operation of the nozzle. It has been found experimentally as described hereinabove in this specification, that in the enhanced embodiment a predetermined volume of around 70 picoliters divided into two consecutively released droplets is optimum for characterizing a nozzle releasing black ink, and a predetermined volume of around 44 picoliters contained as 4 consecutively released droplets is optimum for characterizing a nozzle releasing coloured ink, of a colour other than black. In step 1130, the number identifying the current pair is incremented by 4. By this means, the nozzles in the pair number {1,3}, {5, 7}, . . . , {521,523} comprising the first row are tested for correct functionality according to the best mode presented herein.

The number of peak-to-peak counts are then compared to the upper and lower threshold values to determine if all the nozzles in the pair are working or malfunctioning. In case that the number of counts lays between the lower and the upper threshold values, for each nozzle in the pair the individual method of FIG. 9 is performed, in order to assign a working/malfunctioning status to each nozzle.

The skilled in the art may appreciate that in case of larger groups of nozzles a number of options are available. For instance, the individual method can be applied to all the nozzles comprises in the undetermined group. Alternatively, the group can be split into smaller groups and the enhanced embodiment can be applied to each of these smaller groups, preferably split into 2 halves. The smaller groups still remained undetermined can be split again or once the number of nozzles in a certain group is below a certain number, the individual method can be applied.

In step 925, if the number identifying any nozzle in the current pair is less than 524 then steps 905 to 925 are repeated for the next nozzle. In step 940, if the number identifying any nozzle in the current pair is 524, then the perform drop detection step 805 is completed. Otherwise, in step 930, the print head 60 is moved so as to ensure that droplets ejected from the second row of even numbered nozzles passes through the effective detection zone of the infra-red light beam. In step 1140, the number identifying the current pair is set equal to {2, 4} and steps 905 to 925 are repeated for the even numbered nozzles comprising the second row of the print head.

In a further embodiment each nozzle in a subset or preferably in a pair ejects the same number of droplets as in the individual method, i.e. each nozzle in the black pen spits 2 droplets, each nozzle in the color pen ejects 4 droplets. Clearly this means that the signals generated are going to be different and so the values for the thresholds.

The skilled in the art, by following the teaching of the present application may easily identify the appropriate values for the upper and lower thresholds. In particular, he may appreciate that the number of drops fired by a pen and the frequency should be tuned in such a way that the drop detector may easily discriminate between the distribution of a signal coming from a group of all working nozzles and a group of all failing nozzles, i.e. by dimensioning the gap between the upper threshold and the lower threshold.

Reducing the time required to test the individual nozzles of a plurality of nozzles comprising a print head and reduces the total time required to test a print head. A decrease in the time required to test a print head also corresponds to an increase in drop detect throughput. Increased drop detect throughput results in the following improvements:

It is possible to perform an increased number of tests of each nozzle of the plurality of nozzles without substantially effecting the total time required to print a page;

Increasing the number of tests on each nozzle improves reliability of the print head since this yields a more up to date knowledge of the state of the print heads;

More accurate knowledge of the misfunctioning nozzles improves the operation of error hiding print modes performed by the printer device. Error hiding print modes operate by deactivating a misfunctioning nozzle and reusing a functioning nozzle to print in its place during a print operation; and Increased tests on the functioning of nozzles enables more accurate functioning of a set of servicing algorithms via the printer device. The servicing algorithms are sets of instructions performed before printing a page, during printing and after a page has been printed and are designed to maintain correct operation of the nozzles comprising the print head. Improved servicing of the nozzles results in an increased operating lifetime of the print head.

It is possible to use the technique in printing devices employing inkjet pens with a grater number of nozzles, e.g. swath print bars having nozzles distributed along the entire print zone, or a grater number of pens, e.g. pens having additional colors like light cyan, light magenta, orange or green etc.

What is claimed is:

1. An ink jet printing device comprising:

a printer head comprising a plurality of nozzles for ejecting ink;

means for detecting a pre-determined sequence of droplets of ink ejected from said plurality of nozzles, said detecting means operable to generate an output signal pulse in response to said detected pre-determined sequence of droplets of ink; and means for performing a measurement on each said output signal pulse of said detecting means, wherein for a group of said nozzles, said measurement means performs measurements on an output signal pulse generated in response to said detected predetermined sequence of ink droplets containing a predetermined volume of ink.

2. A device as claimed in claim 1, wherein said group of said nozzles comprises 2 nozzles.

3. A device as claimed in claim 2, wherein said 2 nozzles are contiguous.

4. A device as claimed in claim 1, wherein said predetermined sequence of droplets is ejected in sum from the nozzles in said group of nozzles.

5. A device as claimed in claim 1, wherein said predetermined sequence of droplets is ejected from each nozzle in said group of nozzles.

6. A device as claimed in claim 4, wherein said number of detected ink droplets per said group said nozzle is two or four.

7. A device as claimed in claim 5, wherein said number of detected ink droplets per each nozzle in said group said nozzle is two or four.

8. A device as claimed in claim 1 wherein said nozzles in said group of nozzles are all contiguous and in a same row of nozzles.

9. A device as claimed in claim 1, wherein said measurement means comprises a digital sampling means operable to sample said detected output signal pulse with a sampling period between samples in the range 12 $\mu$s to 50 $\mu$s.

10. A device as claimed in claim 1, wherein said detecting means is operable to output an analogue said output signal pulse having an amplitude perturbation comprising a first portion of a lower amplitude than a steady state amplitude output signal of said detecting means, and a second amplitude portion of a higher amplitude than said steady state amplitude output signal.

11. A device as claimed in claim 1, wherein said means for detecting said predetermined sequence of droplets of ink ejected from said at least one nozzle of said plurality of nozzles comprises:

an emitting element configured to emit a light signal;

a receiving element configured to receive said light signal; and a means for rigidly locating said emitting element with respect to said receiving element.

12. An ink jet printing device configured to print onto a print medium, said device comprising:

a print head comprising a plurality of nozzles, an elongate rigid connecting member having a first end and a second end;

a first housing arranged for mounting an emitter device, said first housing rigidly attached to said first end of said elongate rigid connecting member; and a second housing arranged for mounting a detector device, said second housing attached rigidly to said second end of said elongate rigid connecting member, wherein said print head is located with respect to said first housing and said second housing such that at least two or more ink droplets ejected from a group of nozzles of said plurality of nozzles of said print head passes between said first housing and said second housing, in a trajectory which intersects a beam path between said emitter device and said detector device, said printer device further comprising means for measuring an output signal of said detector device, said measurement means operating to generate for said group of nozzles a signal indicating a performance of said group of nozzles, in response to a said detector signal resulting from passage of said two or more ink droplets containing a predetermined volume of ink across said beam path.

13. A method for determining an operating characteristic of a nozzle of a print head of an ink jet printer device having an ink drop detection means, said nozzle being configured to eject a plurality of drops of ink, said method comprising the steps of:

sending an instruction to said print head to eject a predetermined sequence of at least two drops of ink from a group of nozzles comprising said nozzle, said predetermined sequence of at least two drops containing a predetermined volume of ink;

generating an output signal of said ink drop detecting means, said output signal generated in response to said predetermined sequence of at least two ink drops;

measuring said output signal of said ink drop detecting means; and determining said operating characteristic of said nozzle from said output signal.

14. The method as claimed in claim 13, wherein said predetermined volume of ink lies in the range 30 picoliters to 100 picoliters.

15. The method as claimed in claim 13, wherein said predetermined sequence comprises two or four consecutively released ink drops from all the nozzles in said group of nozzles.

16. The method as claimed in claim 13, wherein said group of nozzles contains two nozzles.

17. The method as claimed in claim 16, wherein said predetermined sequence comprises two or four consecutively released ink drops per nozzle in said group of nozzles.

18. The method as claimed in claim 13, wherein said step of measuring said output signal comprises sampling said signal at a sample frequency in the range 30 kHz to 50 kHz.

19. The method as claimed in claim 13, wherein said step of sampling said output signal comprises performing sampling with a period between samples in the range 12 $\mu$s to 50 $\mu$s.

20. The method as claimed in claim 13, wherein said step of measuring said output signal of said ink droplet detection means comprises for each of said plurality of ink drops the steps of:

waiting a fixed time period after said instruction is sent to said print head;

performing a sequence of measurements on said output signal of said ink drop detecting means, wherein said sequence of measurements measure said output signal of said ink drop detection means at a plurality of time intervals.

21. The method as claimed in claim 13, wherein said step of determining said operating characteristic comprises analysing a sequence of at least one perturbation of said output signal produced in response to a predetermined volume of ink passing said detecting means.

22. The method as claimed in claim 13, wherein said step of determining said operating characteristics of said nozzle comprises for each said ink drop, the steps of:

identifying a largest value of output signal of said ink drop detecting means;

identifying a smallest value of output signal of said ink drop detecting means; and subtracting said smallest value of output signal of said ink drop detecting means from said largest value of output signal level of said ink drop detecting means.

23. A method as claimed in claim 13, wherein said step of determining an operating characteristic of a said nozzle comprises the steps of:

determining a value of a perturbation of said output signal; and comparing said value of perturbation with a first and a second threshold values, wherein said first threshold value is set at least six standard deviations above an average noise level of said output signal.

24. A method as claimed in claim 23, wherein said step of determining an operating characteristic of a said nozzle further comprises the steps of:

if said value of perturbation is equal or below said first threshold value, or equal or above said second threshold values, assign to said nozzle and the remaining nozzles in said group of nozzles the same operating characteristic.

25. The method as claimed in claim 13, wherein said step of determining an operating characteristic of a said nozzle further comprised the step of: if said value of perturbations comprised between said first and said second threshold values, repeating the steps as claimed in claim 13 but having said group of nozzles comprising solely said nozzle.

26. A method for evaluating an operation of each nozzle of a print head comprising a plurality of nozzles, said nozzles being configured to eject a plurality of drops of ink, said method comprising the steps of:

a) grouping said plurality of nozzles into a number of groups of nozzles;

b) sending an instruction to said print head to eject a predetermined sequence of drops of ink from nozzles of a first group of said plurality of nozzles, each said sequence of drops containing a predetermined volume of ink;

c) generating an output signal of an ink drop detecting means for each sequence of drops detected;

d) measuring said output signal of said ink drop detecting means for each sequence of drops detected;

e) determining an operating characteristic of each nozzle in said group from said output signal;

f) If the operating characteristic of each nozzles in said group is unknown from said output signal, split said group into smaller groups containing less nozzles and repeat steps (b) to (f) for all such smaller groups;

g) repeating steps (b) to (e) for each of said number of groups of nozzles.

* * * * *